US008654037B2

(12) United States Patent
Harrysson et al.

(10) Patent No.: US 8,654,037 B2
(45) Date of Patent: Feb. 18, 2014

(54) ARRANGEMENT FOR OPTICAL REPRESENTATION AND WIRELESS COMMUNICATION

(75) Inventors: Fredrik Harrysson, Göteborg (SE); Jonas Medbo, Uppsala (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 806 days.

(21) Appl. No.: 12/746,728

(22) PCT Filed: Dec. 6, 2007

(86) PCT No.: PCT/EP2007/063403

§ 371 (c)(1),
(2), (4) Date: Jun. 7, 2010

(87) PCT Pub. No.: WO2009/071126

PCT Pub. Date: Jun. 11, 2009

(65) Prior Publication Data

US 2010/0265161 A1 Oct. 21, 2010

(51) Int. Cl.
*G09G 5/00* (2006.01)

(52) U.S. Cl.
USPC ..... 345/2.3; 345/204; 345/205; 345/207

(58) Field of Classification Search
USPC ..... 345/2.3, 32, 76, 77, 82, 98, 104, 204, 345/205, 207, 692; 128/898; 349/43, 44, 349/110, 159; 315/169.3; 343/702
See application file for complete search history.

(56) References Cited

U.S. PATENT DOCUMENTS 4,299,447 A 11/1981 Soltan et al.
5,293,437 A 3/1994 Nixon
5,661,506 A * 8/1997 Lazzouni et al. ..... 345/179
5,818,998 A 10/1998 Harris et al.
6,492,973 B1 * 12/2002 Araki et al. ..... 345/100
6,628,867 B1 9/2003 Solntsev
6,937,215 B2 * 8/2005 Lo ..... 345/82
7,019,391 B2 * 3/2006 Tran ..... 257/678
7,196,317 B1 * 3/2007 Meissner et al. ..... 250/227.14
8,213,757 B2 * 7/2012 Harrysson et al. ..... 385/120
2002/0036593 A1 3/2002 Ying
2003/0025933 A1 * 2/2003 Kimura et al. ..... 358/1.15
2006/0267887 A1 * 11/2006 Matsueda ..... 345/76
2006/0278240 A1 * 12/2006 Spillman et al. ..... 128/898
2007/0040769 A1 * 2/2007 Tai et al. ..... 345/76
2007/0081354 A1 4/2007 Wahlstrom (Continued)

FOREIGN PATENT DOCUMENTS

EP 1866263 A1 12/2007
WO WO 2006/042735 A 4/2006

*Primary Examiner* — Prabodh M Dharia

(57) ABSTRACT

A functional, primary display means comprises a number of first, small pixel elements and comprises or communicates with image generating means for generation of a high resolution miniature image. A main display means comprises a dielectric material which is transparent to radio-, and/or millimeter waves and/or microwaves and comprises a number of second, passive, pixel elements substantially corresponding to, and considerably larger than, the first pixel elements. Each first pixel element is connected to a second pixel element by an optical transmission means for transfer of optical image information. The main display means is adapted to visually represent the transferred optical information as an enlarged image and receiving/transmitting means for communication of radio-, millimeter wave or microwave signals are arranged in or on the main display means such that reception/transmission can take place substantially independently of the optical representation.

19 Claims, 10 Drawing Sheets

(56) References Cited

U.S. PATENT DOCUMENTS

| | | | | |
|---|---|---|---|---|
| 2008/0012817 | A1* | 1/2008 | Chen et al. | 345/100 |
| 2008/0018567 | A1* | 1/2008 | Minami | 345/77 |
| 2008/0111848 | A1* | 5/2008 | Silverbrook | 347/20 |
| 2008/0198184 | A1* | 8/2008 | Schellingerhout et al. | 345/692 |
| 2008/0316232 | A1* | 12/2008 | Ryu et al. | 345/690 |
| 2009/0002316 | A1* | 1/2009 | Rofougaran | 345/156 |
| 2010/0073995 | A1* | 3/2010 | Tran | 365/151 |
| 2010/0260460 | A1* | 10/2010 | Harrysson et al. | 385/119 |
| 2010/0261445 | A1* | 10/2010 | Harrysson et al. | 455/129 |

* cited by examiner

ARRANGEMENT FOR OPTICAL REPRESENTATION AND WIRELESS COMMUNICATION

TECHNICAL FIELD

The present invention relates to a display arrangement comprising display means associated with receiving and/or transmitting means for communication of radio-, millimeter- or microwave signals. Particularly it relates to a display arrangement with receiving and/or transmitting capability for a wireless communication terminal.

BACKGROUND

Wireless communication terminals have to be equipped both with a display screen and with receiving and transmitting means, more specifically antenna means. It is important that the display means is able to present optical information with a high resolution and of a high quality. It is also important that the receiving and transmitting capability of the wireless communication terminal is good. Among other things it should be possible to provide a good coverage for all possible radio communication channels (supposing that the wireless communication terminal communicates by means of radio waves). For the communication network it is important to be able to provide a good transmission capacity and quality, for single links as well as for the radio network as a whole. It should also be possible to exploit the potential transmission capacity as much as possible. Therefore a wireless communication terminal may be equipped with multiple antennas which couple independently to the different degrees of freedom of a radio channel. For a single wave, the degrees of freedom are generally the direction and the polarization, whereas in a real channel, a transmitted wave is scattered by physical objects in the surrounding environment, resulting in a so called multi-path channel. For a multi-path channel there are many different pathways corresponding to different directions, at the receiver as well as at the transmitter.

For a laptop (one example of a wireless communication terminal) it is known to use the frame surrounding the laptop display for an antenna means. However, the available space on the frame is quite limited which restricts where and how antenna means can be located and it becomes difficult to take full advantage of the available data transmission capacity and to meet the objects referred to above. It also becomes difficult to handle real multi-path channels. In addition thereto, since the available space is limited, it is not possible to position antenna elements according to the needs to a sufficient extent, at least for many applications, particularly for advanced wireless communication systems or high speed wireless communication systems which require multiple antennas or antenna arrays. This means that it becomes difficult to provide sufficient coverage for all possible radio channel directions. To overcome these problems, the frame could be made larger which either would result in a larger laptop, which is inconvenient, or in a smaller screen. With a smaller screen, the optical representation capability will suffer, which also is inconvenient.

As an alternative to the frame, it is also known to use the back side of a laptop display for an antenna arrangement. Then the antenna elements will be screened in the opposite direction and since the radio paths having the best gain typically are concentrated within in a limited angular range, the strongest paths then will be heavily attenuated, which is a serious problem. This problem will be of considerable importance for future high speed wireless communication systems.

As can be seen there are so far no satisfactory solutions, particularly for wireless communication units, to provide a functioning display for optical representation at the same time as a flexible and controllable antenna arrangement, since the location of the antenna arrangement is given by the display arrangement. Either it has to be located at the back of the display or in the frame surrounding the display, which strongly limits the capacity/quality of the antenna arrangement. A fundamental problem is that the antenna arrangement and the display arrangement in known arrangements interfere with each other or affect each other negatively and so far it has not been possible to provide a combined arrangement wherein both functionalities (the functionality of optical representation and the functionality of receiving/transmitting radio waves etc.) fulfill high requirements at the same time. It has so far not been possible to provide a combined display and antenna arrangement, or more a generally a receiving/transmitting arrangement, wherein the display and its optical representation capabilities are not impaired or affected by the antenna arrangement and, vice versa, wherein the antenna arrangement and particularly its receiving and transmitting capabilities are not impaired by the display arrangement.

SUMMARY

It is therefore an object of the present invention to provide a display arrangement as initially referred to, or a combined display and receiving and/or transmitting arrangement for radio-, millimeter or microwaves which is well functioning, both as far as optical representation is concerned and as far as receiving and/or transmitting properties are concerned, while still meeting other requirements as to size, form etc. It is also an object of the invention to provide a combined display and receiving and/or transmitting arrangement, particularly an antenna arrangement, wherein the display means and the antenna arrangement do not interfere such that the properties of one or the other are negatively affected. Particularly it is an object to provide an arrangement as referred to above with receiving/transmitting means combined with antenna means through which it becomes possible to efficiently cover many or all different directions of a radio communication channel.

Moreover it is an optional object to provide an arrangement through which a wireless communication device with a display, such as a laptop, can be equipped with multiple antennas or antenna arrays coupling independently to different degrees of freedom of a transmission/reception radio channel. Another object is to provide an arrangement as referred to above through which it becomes possible to receive/transmit on the strongest radio paths. More particularly it is an object to provide a flexible and controllable co-located display and antenna arrangement that can be used in communication devices such as laptops, palmtops, mobile phones etc. and which is easy and cheap to fabricate and wherein the antenna means can be made large enough without requiring extra space, e.g. requiring that the display screen is made small due to a large frame etc. It should also allow transmission/reception on possible or desired directions while not suffering from screening problematics and be appropriate for multipath radio, millimeter or microwave signals. It is moreover an object to provide a combined display and antenna arrangement which is flexible and provides a large freedom as far as construction of the antenna arrangement is concerned and which is possible to adapt to relevant applications and which allows or opens up for many processing options of the radio signals.

Therefore a display arrangement as referred to above is provided wherein the display means comprises a functional primary display and a main display means. The functional primary display comprises a number of first, small pixel elements, and comprises or communicates with image generating means, for generation of a high resolution image, for example a compressed image or a miniature image. The main display comprises a number of second pixel elements substantially corresponding to the number of first, small, pixel elements. The second pixel elements are considerably larger than said first pixel elements and each first pixel element is connected to a second pixel element by means of an optical transmission means for optical transfer of the miniature or compressed image. The main display is adapted to visually represent the transferred image as an enlarged image. It is transparent to radio/millimeter or microwaves. The receiving and/or transmitting means of the antenna means are arranged in association with the main display means, preferably on the back or on the front thereof.

It is an advantage of the invention that a combined display and antenna arrangement is provided which has a good optical representation capability as well as a good receiving/transmission capability for radio/millimeter/microwaves. It is particularly an advantage that a combined display and antenna arrangement is provided in which the antenna arrangement does not have any influence whatsoever on, or does not interfere with, the display arrangement and vice versa. Particularly it is an advantage that the antenna elements of the antenna arrangement do not screen the display arrangement and, vice versa, that the display arrangement does not screen the receiving/transmitting elements. It is also an advantage that a combined antenna and display arrangement is provided through which substantially the whole area of the display surface is available and can be used for a receiving/transmitting functionality. Particularly it is an advantage that it becomes possible to locate and arrange antenna elements or arrays in a most efficient manner within the case of for example a wireless communication device, for example a laptop, palmtop or similar such that all possible directions of a communication channel, particularly a radio channel, can be covered and that it becomes possible to utilize optional portions of, or the entire, display surface for radio communication as well as for optical presentation. It is also an advantage that transmission capacity can be boosted and that an extra-ordinarily effective antenna array with high gain and omnidirectional properties for beam-forming and spatial multiplexing can be provided for use in for example laptops or other wireless communication terminals.

BRIEF DESCRIPTION OF THE DRAWINGS

The invention will in the following be further described, in a non-limiting manner, and with reference to the accompanying drawings, in which.

DETAILED DESCRIPTION

Figure 1:
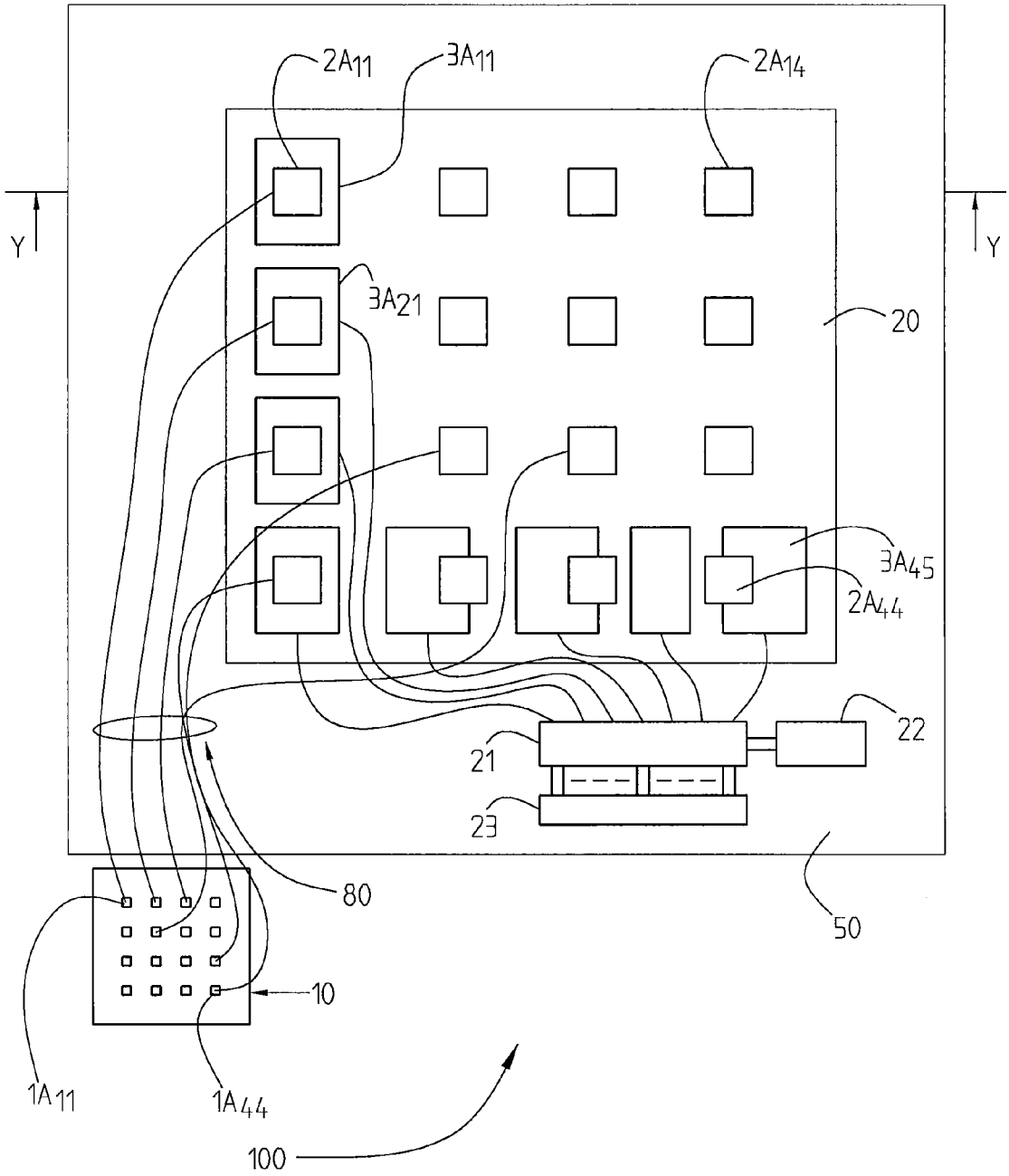
FIG. 1 is a schematical block diagram of a display and antenna arrangement according to a first embodiment.

FIG. 1 illustrates a display and antenna arrangement 100 which comprises a primary functional display means 10 comprising a number of small pixel elements $\mathbf{1}A_1, \ldots, \mathbf{1}A_{44}$ which are connected to image generating means, e.g. a graphics card, (not shown). The primary, functional display means 10 acts as an image source with a high resolution and high intensity. The small pixel elements, particularly light-emitting diodes (LEDs), are by means of a bundle of optical fibers 80 acting as waveguides connected to larger, passive, second pixel elements $\mathbf{2}A_{11}, \ldots, \mathbf{2}A_{44}$ of a main display 20 for visual representation of the image. Thus, the miniature image generated in the primary functional display means 10 is magnified and projected onto the main display screen 20 via the optical fibers 80. The miniature image can be generated by conventional digital projector technology. It is however an advantage that generation of the image may be done with a technology which is a quite simple and cheap, since the light intensity does not have to be very strong. The optical fibers 80 are dielectric as well as the main screen which allows mounting of RF elements $\mathbf{3}A_{11}, \ldots, \mathbf{3}A_{45}$ (or more generally receiving/transmitting elements) directly behind the main display 20 and to radiate through it. Here the antenna elements comprise antenna patches; that the number of antenna patches is similar to the number of second pixel elements is purely coincidental and there is no relation between number, shape and type of antenna elements and pixel elements.

The antenna patches $\mathbf{2}A_{11}, \ldots, \mathbf{2}A_{44}$ are by means of transmission lines connected to a distribution network 21 comprising feeding means, combining and/or switching means which are controllable by digital control means 22. By means of antenna ports the antenna elements are connected to an RF receive/transmit (RX/TX) chain 23. The miniature or compressed first pixel elements of the primary functional display 10 are connected to a bundle 80 of optical fibers. The fiber ends of the other end of the bundle are spread out and mounted onto a dielectric optically transparent surface comprising the second, larger pixel elements. Accuracy of the image on the main screen 20 can be achieved by very precise mounting of the fiber ends or alternatively by remapping the pixels of the primary functional display connected to the image generating means providing the relevant information which is made possible through initial calibration measurements. The fiber end positions may be randomized, but known, and the pixel elements of the primary, functional display means are remapped accordingly in an image generating computer. Also the light intensity and the colour of the pixels may be adjusted by using the remapping procedure. Since the optical fibers have very low losses, the image produced by the primary functional display means acting as an image source, can be placed at any suitable location.

The main display screen 20 to which the optical fibers are connected is preferably completely dielectric and therefore transparent to radio waves. This means that any RF antenna arrangement (or antenna arrangement receiving/transmitting radio- or millimeter waves or microwaves) can be arranged directly behind the screen without having any influence on the optical image of the main display screen, and without being influenced by the main display screen, which is extremely advantageous. Here the primary functional display means 10 is illustrated as been located outside the carrier 50, for example a laptop screen carrier, but of course it could also be provided somewhere on the display screen or elsewhere on the laptop, e.g. in the frame of the screen, if the arrangement is to be implemented in a laptop. The location of the primary functional display means can be selected arbitrarily as long as any other requirements concerning for example fiber lengths, compactness etc. are met.

Figure 2:
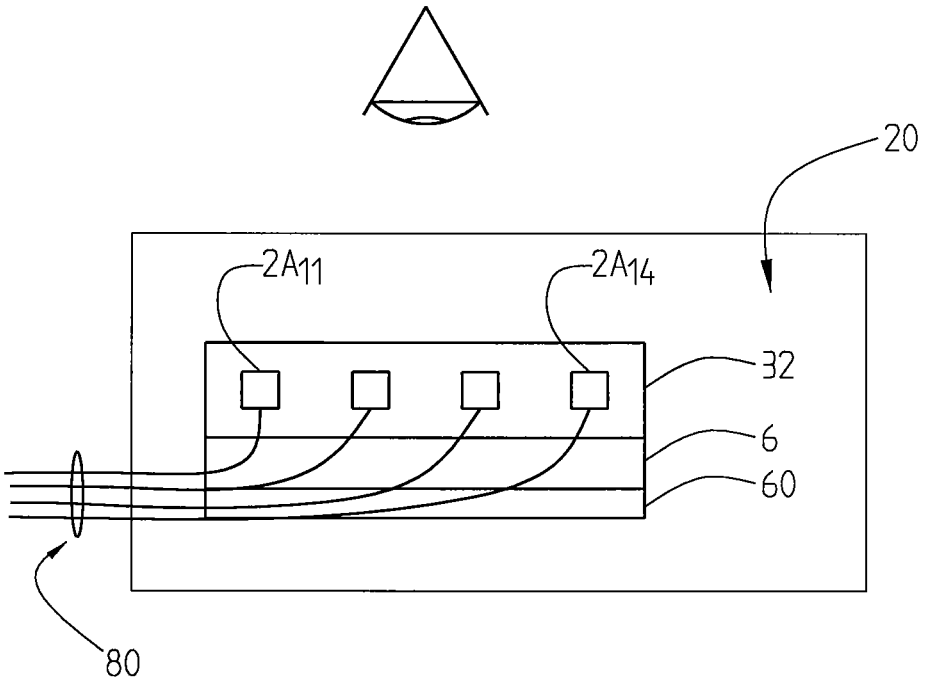
FIG. 2 is a cross-sectional view in smaller scale along the section Y-Y in FIG. 1.

FIG. 2 is a simplified cross-sectional view of reduced size along Y-Y in FIG. 1 showing the display means 20 which in this embodiment comprises a number of pixel elements $\mathbf{2}A_{11}$, $\mathbf{2}A_{14}$ (merely one row of pixel elements shown) and it should be understood that of course the number of pixel elements in a row normally is much higher, not more pixels shown for reasons of clarity. The pixel elements are arranged in the non-conductive, dielectric display layer 32 and they are connected by means of the, likewise dielectric, optical fibers 80 with primary functional display means (not shown). At the back of the main display means 20 an antenna layer comprising antenna means 6 is schematically illustrated which in turn may be disposed on a ground plane 60. It is here supposed that the antenna means 6 comprises a number of antenna patches (not shown in FIG. 2) requiring a ground plane 60. In this figure no antenna feeding means etc. are illustrated for reasons of clarity. The eye in the figure illustrates the viewing direction, which is the front or top of the main display. The antenna means 6 are here located at the back of the main display 20 and, since the main display is dielectric, there is no interference and the antenna elements can receive/transmit or radiate through the main display means. No grounding layer is actually needed for the main display means which means that a particular grounding layer 60 has to be provided if the antenna elements are patches. It may be provided at the back of the antenna means 6. If the antenna elements instead comprise coplanar elements or dipoles, no ground layer is needed.

Figure 3:
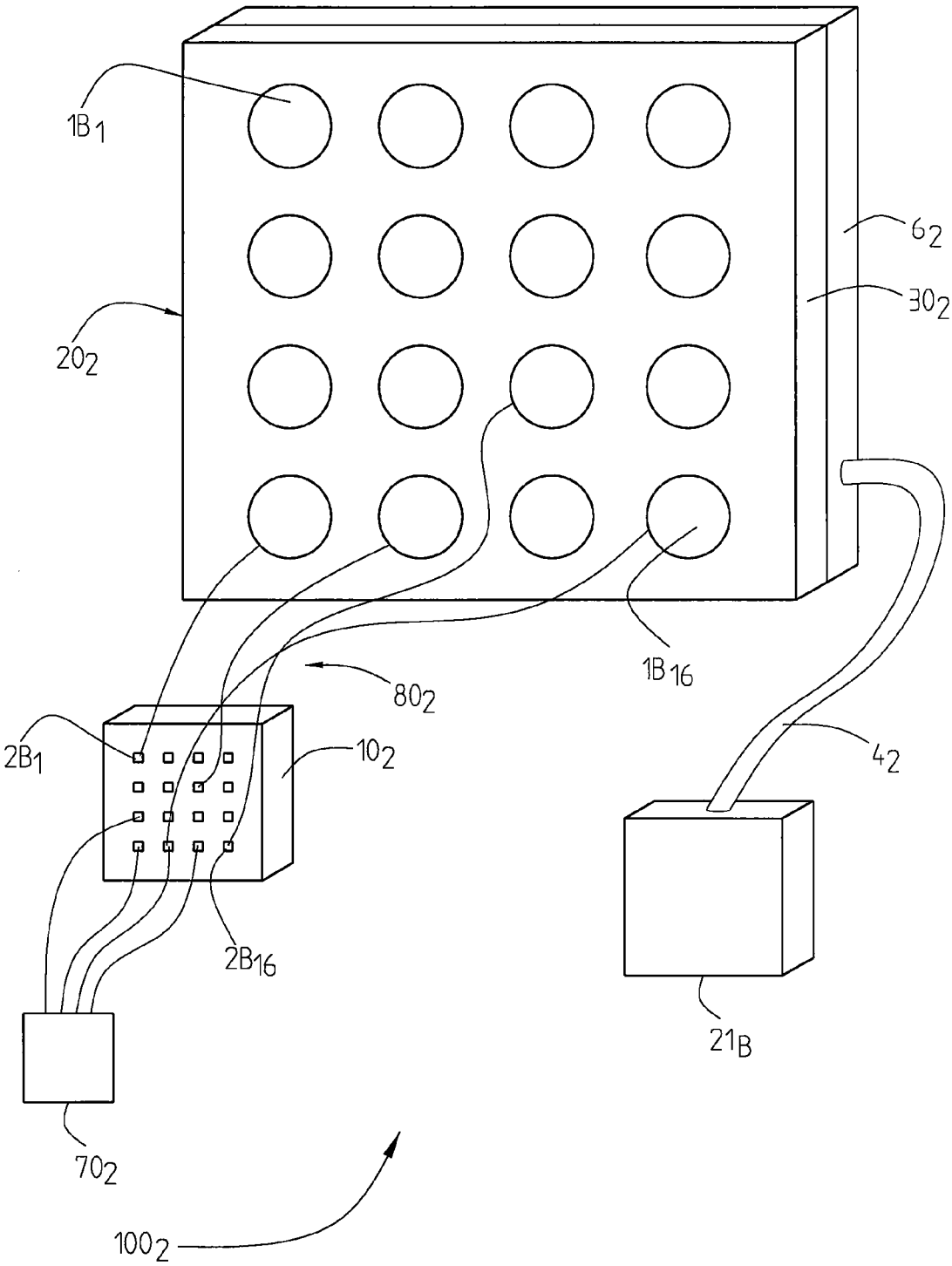
FIG. 3 is a very schematical block diagram partly in perspective of an arrangement according to the invention, FIG. 4 schematically illustrates an implementation with a display and antenna arrangement according to the invention arranged in a laptop.

FIG. 3 very schematically illustrates a display antenna arrangement $\mathbf{100}_2$ according to another embodiment. Primary functional display means $\mathbf{20}_2$ comprises pixel elements $\mathbf{2}B_1, \ldots, \mathbf{2}B_{16}$ which are connected to image generating means $\mathbf{70}_2$, for example a graphic card or similar. The pixel elements $\mathbf{2}B_1, \ldots, \mathbf{2}B_{16}$ particularly comprise small light emitting diodes, LEDs. By means of optical waveguides, a bundle of optical fibers $\mathbf{80}_2$, each pixel element $\mathbf{2}B_1, \ldots, \mathbf{2}B_{16}$ is connected to respective larger second pixel elements $\mathbf{1}B_1, \ldots, \mathbf{1}B_{16}$ of the main display means $\mathbf{20}_2$, as discussed above. The pixel elements of the main display means $\mathbf{20}_2$ are here illustrated as circular; the shape is here of no significance, they may have any shape, in all embodiments. The second pixel elements $\mathbf{1}B_1, \ldots, \mathbf{1}B_{16}$ are provided in a dielectric, non-conductive pixel layer $\mathbf{30}_2$ on which an antenna means $\mathbf{6}_2$ is disposed. It is here supposed that the antenna means comprises a plurality of dipole antenna elements (not shown in the figure). Conducting wires $\mathbf{4}_2$ connect the dipole antenna elements to feeding, switching and/or combining means 21B. Since the antenna means here is constituted by dipole antennas, no grounding functionality is needed.

Figure 4:
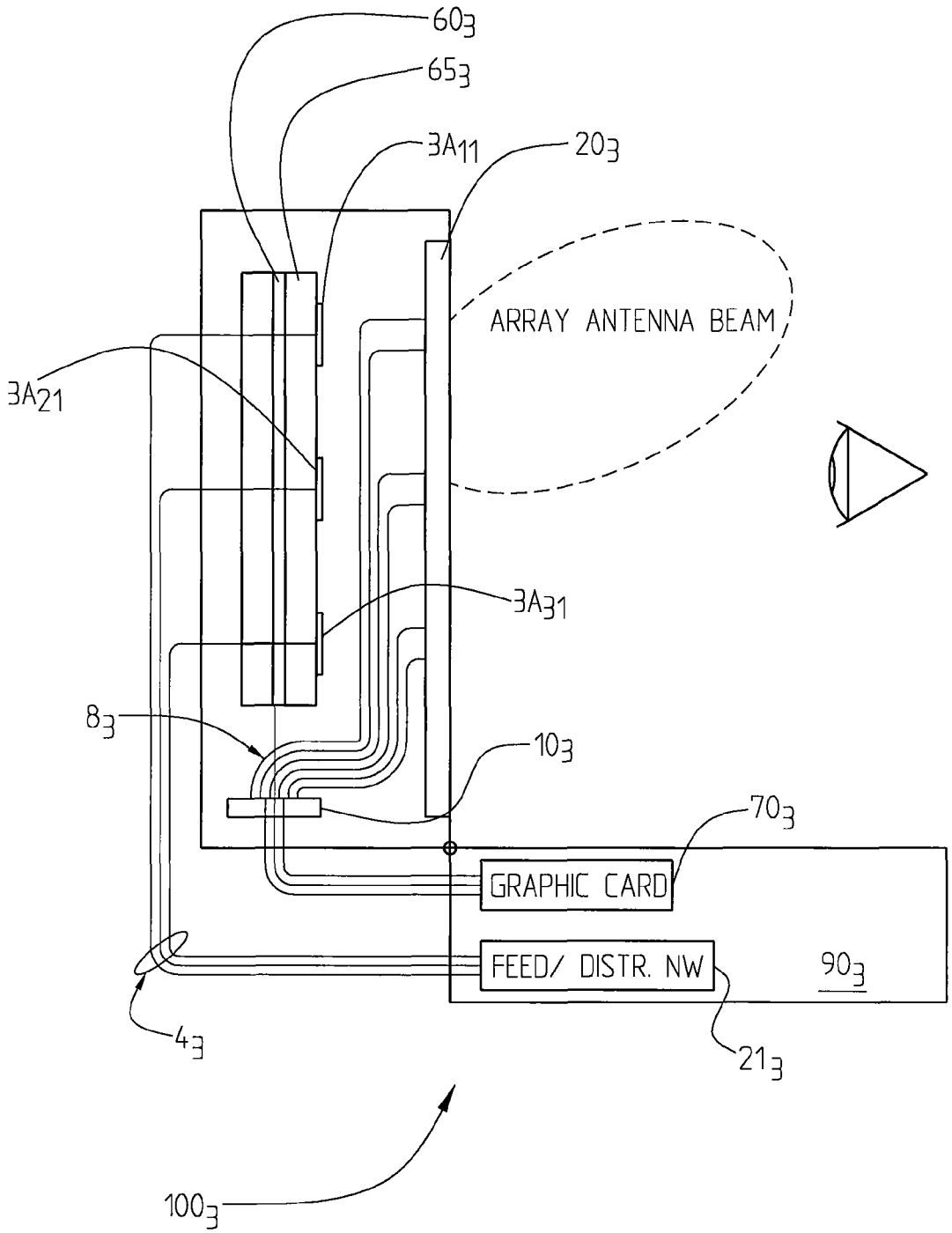

FIG. 4 schematically illustrates one implementation of an inventive arrangement $\mathbf{100}_3$ in a laptop. An image information means in the form of a graphic card $\mathbf{70}_3$ is arranged in the laptop $\mathbf{90}_3$ and it provides information to primary functional display means $\mathbf{10}_3$ here shown in the display part of the laptop. It may also be located elsewhere, e.g. in the neighbourhood of the graphic card. The primary display means $\mathbf{10}_3$ can be said to act as a projector screen comprising a number of LEDs which are connected by means of optical fibers $\mathbf{8}_3$ to a secondary or main screen $\mathbf{20}_3$ acting as a projection screen presenting the image to a user. Since the main display $\mathbf{20}_3$ is entirely dielectric, an antenna means comprising antenna array elements, here antenna patches $\mathbf{3}A_{11}, \ldots, \mathbf{3}A_{21}$ connected with feed lines $\mathbf{4}_3$ to feeding/distribution network $\mathbf{21}_3$ is provided at the back of the display screen of the laptop $\mathbf{90}_3$. Since the antenna elements here are antenna patches, a ground plane $\mathbf{60}_3$ is needed and through vias are used to feed the respective antenna patches. Any kind of feeding is possible. The antenna patches are here arranged on a support layer $\mathbf{65}_3$ in or on which the conducting ground plane $\mathbf{60}_3$ is provided.

Since the main display means $\mathbf{20}_3$ is non-conducting and dielectric, e.g. a of glass or plastic, the antenna elements are not affected by the display means and the antenna elements can receive/transmit through the main display means, a directional array antenna beam being schematically illustrated in the figure with a dashed line.

Figure 5:
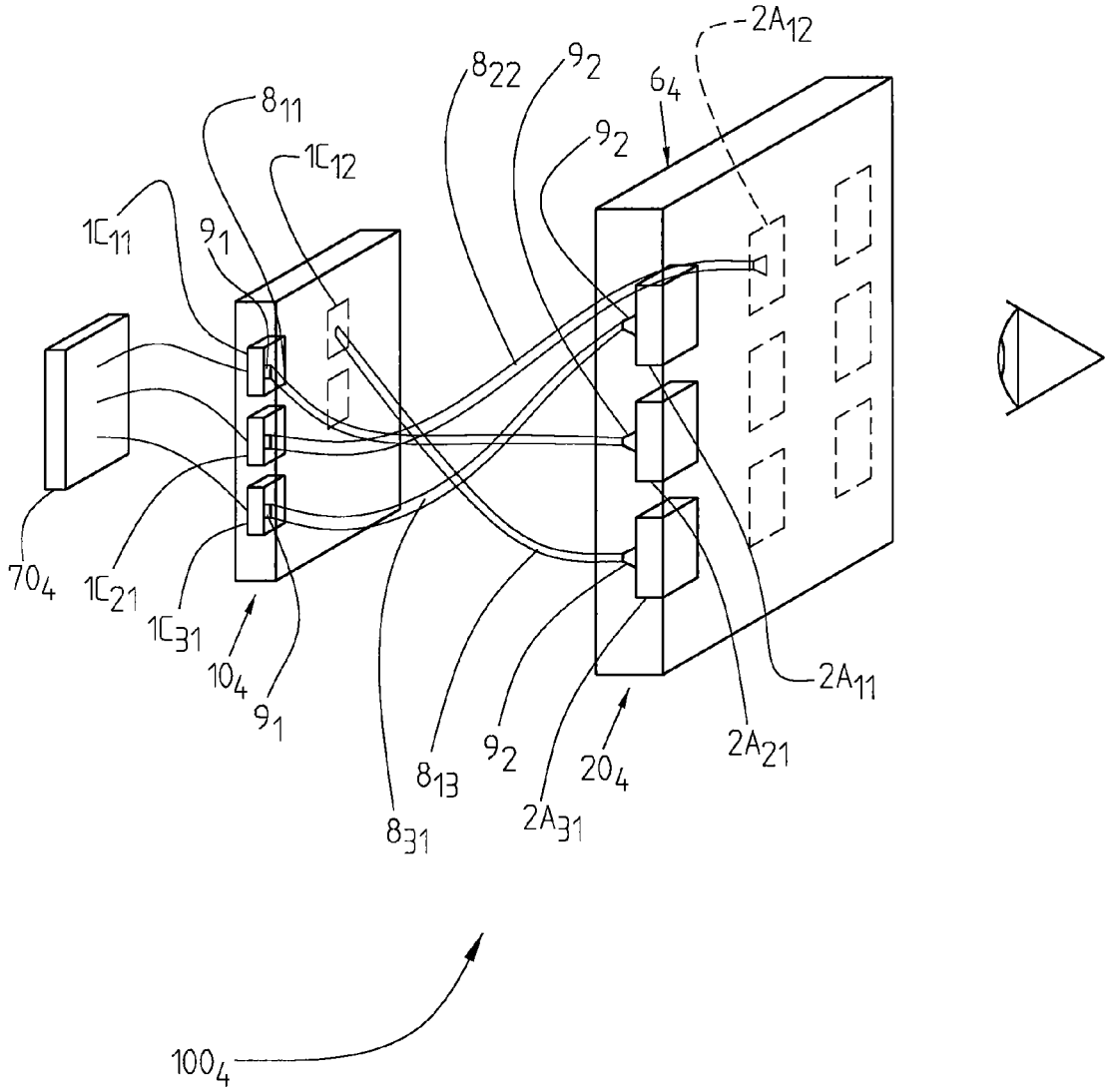
FIG. 5 is a schematical view in perspective of the optical part, a display means, according to the invention.

FIG. 5 is a view in perspective of an arrangement $\mathbf{100}_4$ according to the present invention focusing on the optical part. It comprises a primary functional display $\mathbf{10}_4$ connected to and receiving image information from image information providing means $\mathbf{70}_4$, e.g. a graphic card. The primary functional display means $\mathbf{10}_4$ comprises a number of pixel element $\mathbf{1}C_{11}, \ldots, \mathbf{1}C_{21}$ of which one column is shown from the side which via coupling means are coupled out on optical waveguides (optical fibers) $\mathbf{8}_{13}, \mathbf{8}_{31}, \mathbf{8}_{22}, \mathbf{8}_{11}$ adapted to transfer light to pixel elements $\mathbf{2}A_{11}, \mathbf{2}A_{31}, \mathbf{2}A_{21}$ at the other end of the fibers where optical information is coupled in to main display means $\mathbf{20}_4$ by coupling means $\mathbf{9}_2$. Normally there is a one to one relationship between the number of pixel elements in the first display means and pixel elements in the second display means, but as discussed above, the transfer can be done by means of a mapping or by extremely carefully mounting the fiber ends at the main display. The figure does not show any mapping means and it is supposed that the fiber ends have been mounted with extreme precision in this embodiment. An antenna display means $\mathbf{6}_4$ is placed at the back of the main display screen $\mathbf{20}_4$. For reasons of clarity it is only indicated in the figure.

Figure 6:
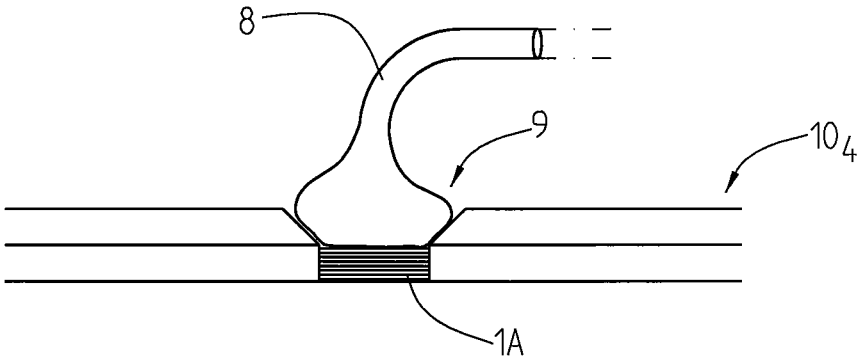
FIG. 6 is an enlarged view of an optical waveguide connecting primary display means with pixel elements of a main display according to the invention.

FIG. 6 very schematically illustrates an optical fiber 8 with coupling means comprising a functional lens 9 which is connected to LED 1A provided in the primary functional display means $\mathbf{10}_4$. In this embodiment the outer end of the optical fiber 8 is shaped so as to form a coupling means with a lens functionality. In an alternative embodiment it is possible to provide separate lenses to, in an appropriate manner, couple light into optical fiber 8. However, it is clearly advantageous to merely shape the end of the optical fiber in the appropriate manner since it is a very simple technique for providing a transfer, coupling and lens functionality.

Figure 7:
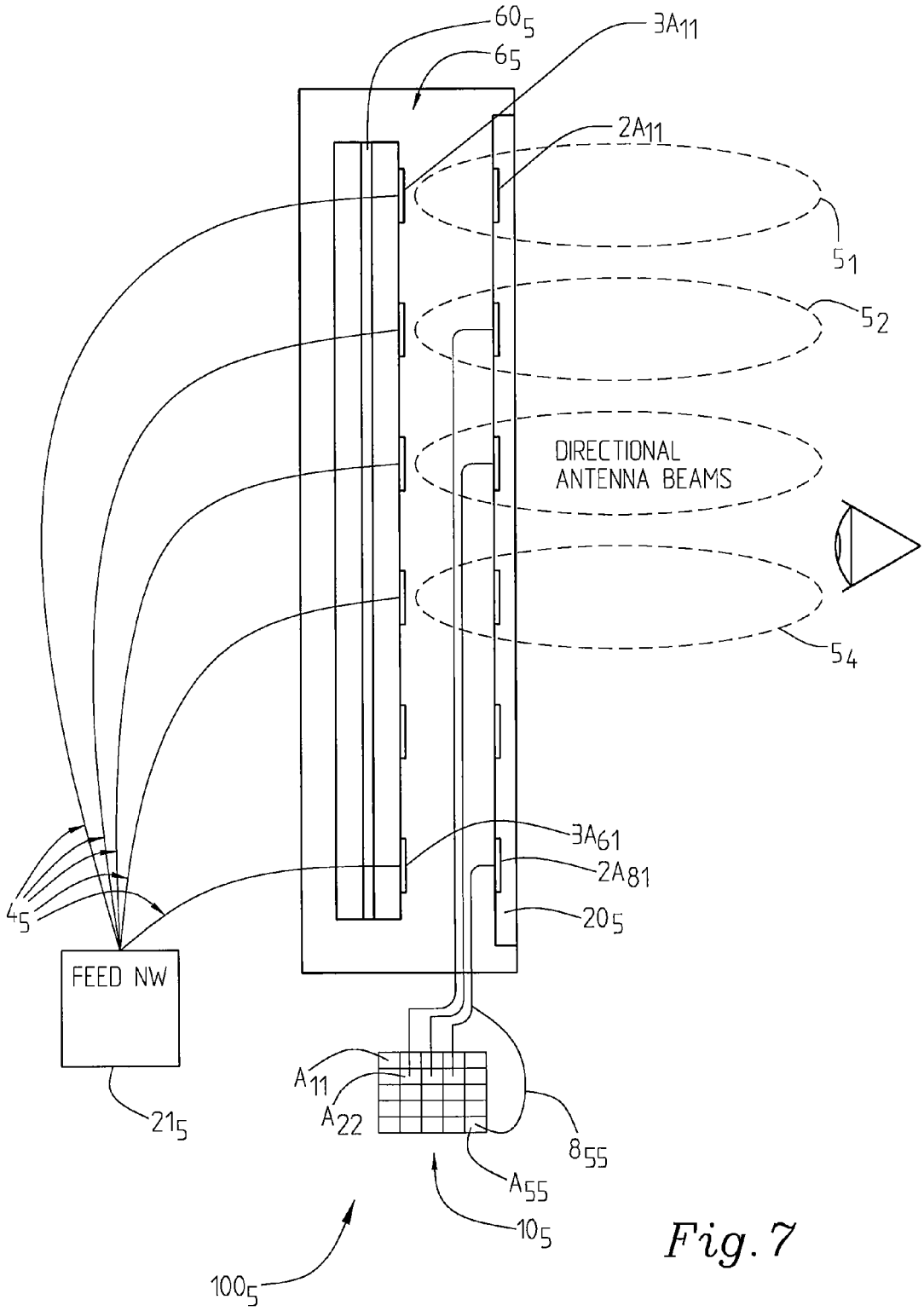
FIG. 7 is a cross-sectional view of an embodiment with antenna means comprising antenna patches.

FIG. 7 shows more in detail an implementation of a display antenna arrangement $\mathbf{100}_5$ according to the present invention. The display arrangement comprises a primary functional display means $\mathbf{10}_5$ connected to an image generator, e.g. a graphic card or similar (not shown). It comprises a number of pixel element comprising LEDs $A_{11}, \ldots, A_{55}$ which via an optical fiber bundle comprising optical waveguides $\mathbf{8}_{22}, \ldots, \mathbf{8}_{23}, \ldots, \mathbf{8}_{55}$ (only some shown for reasons of clarity) connected to pixel elements $\mathbf{2}A_{11}, \ldots, \mathbf{2}A_{61}$ of a main display screen $\mathbf{20}_5$ for optical image representation to a user (illustrated by means of an eye). Since the main screen can be made of any dielectric material which is non-conductive, an antenna means $\mathbf{6}_5$ can be provided at the back of the main screen $20_5$. The antenna means $6_5$ here comprises a number of patch elements $3A_{11}, \ldots, 3A_{61}$ etc. of a directional antenna array with directional antenna beams $5_1$, $5_5$ indicated in the figure. The antenna patches $3A_{11}, \ldots$ are fed by feeding or transmission lines $4_5$ connected to a feeding network $21_5$ which also may comprise a switching and/or combining functionality with RF transceivers etc. Since the antenna means here comprises antenna elements in the form of patch elements, a backing ground plane $60_5$ is required.

Figure 8:
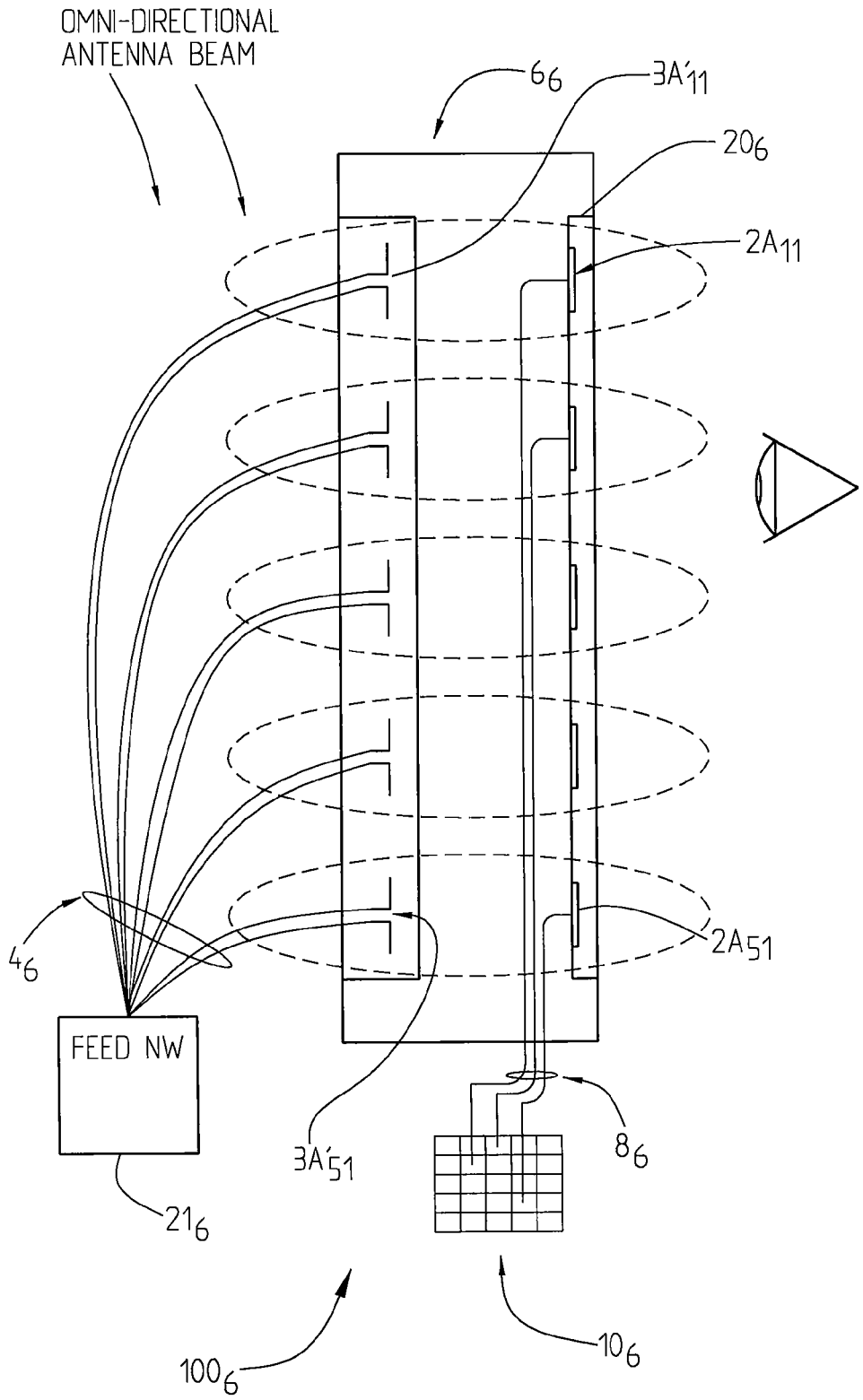
FIG. 8 shows an embodiment of the present invention wherein the antenna means comprises dipole antennas arranged at the back of a display means, FIG. 9 schematically illustrates arrangements according to the invention wherein antenna means are arranged in front of or integrated in a main display.

FIG. 8 shows another implementation of an inventive arrangement $100_6$. LEDs of primary functional display means $10_6$ are via fiber bundle $8_6$ connected to pixel elements $2A_{11}, \ldots, 2A_{61}$ of a main display means $20_6$. Since the main display means $20_6$ can be made entirely dielectric and non-conductive (through the provisioning of the primary, functional display means), as well as the optically fibers of fiber bundle $8_6$, an antenna means $6_6$ can be provided at the back of the main display means $20_6$. Here it is supposed that the antenna means $6_6$ comprises antenna elements in the form of dipole antennas $3A'_{11}, \ldots, 3A'_{51}$. Each dipole antenna element is connected via two connection wires (all connection wires to all antenna elements in the figure simply indicated by reference sign $4_6$) to feeding network $21_6$ which as in the embodiment discussed above may comprise switching/combining functionalities with RF transceivers etc. It is supposed that omnidirectional antenna beams are provided, the antenna array comprising an omnidirectional antenna array and, since the antenna elements comprise dipole elements, no ground plane is needed. It should be clear that the distances for example between antenna means and main display means are not correctly illustrated in the figure; the distances may assume different values, the means may be arranged close together or with some distance, the main thing being that it is illustrated that an antenna means can be arranged at the back of the main display means and that it is possible to provide an omnidirectional antenna array since the antenna means will not be screened by the display means.

Figure 9:
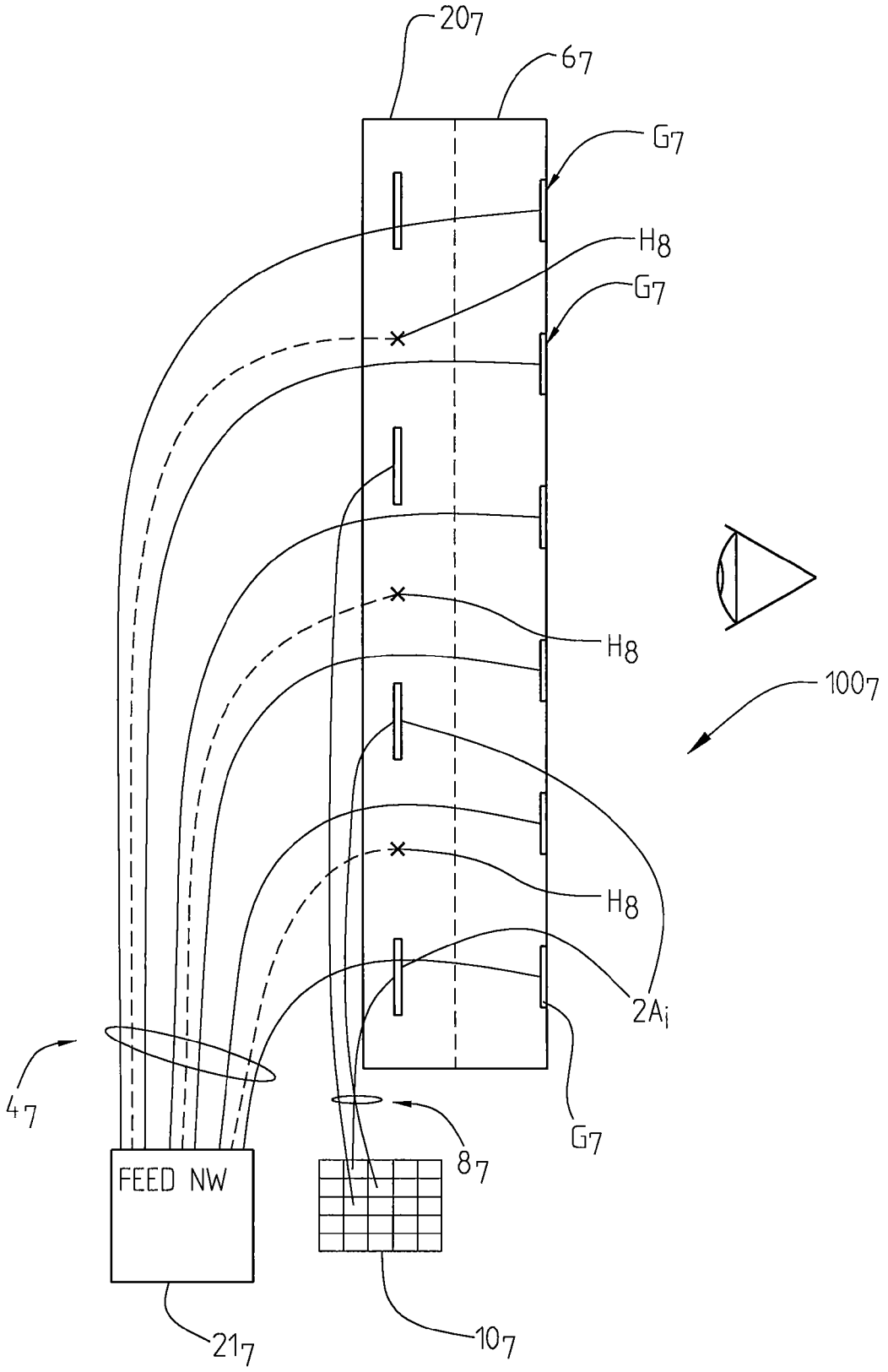

FIG. 9 shows still other possible implementations of a display and antenna arrangement $100_7$. Primary functional display means $10_7$ as above comprises a number of pixel elements only very schematically illustrated and, also as above, each respective pixel element, e.g. LEDs, via fiber bundle $8_7$ being connected to main display means $20_7$ with a number of layer pixel elements, here simply denoted $2A_i$. No image generating means are illustrated since the functioning in that aspect may be the same as described above.

In a first implementation an antenna means $6_7$ comprising a number of antenna patches $G_7$ is located in front of the main display means $20_7$, even if this is not necessary since the second display means $20_7$ actually is dielectric, non-conductive and transparent for RF signals. In this particular embodiment, however, the antenna means $6_7$ is transparent for optical signals, i.e. the antenna elements are arranged in a thin optical transparent electrically non-conductive layer as for example described in the copending patent application denoted "Display Arrangement" filed on the same date and by the same applicant as the present application and the content of which herewith is incorporated herein by reference.

Another embodiment is also indicated in FIG. 9 in which antenna means $H_8$ are integrated with the main display means $20_7$, (although this is not necessary since the main display means does not screen the antenna means). An antenna structure $H_8$ is disposed between the pixel element $2A_1$ of the main display means; "X" indicating wires of an electrically conductive grid providing antenna elements. The pixel elements can be connected to optical waveguides or fiber sections acting as lenses to conduct light to the front of the display means, through the grid. Such an implementation is also described in the patent application filed on the same date by the same applicant and denoted "A Display Arrangement With Enhanced Functionality". It should be clear that FIG. 9 has been used to, in one and the same figure, actually illustrate two different implementations of providing the array antenna means either in front of the main display means or as integrated with the main display means and of course, antenna elements $G_7$ and antenna elements $H_8$ are not provided in one and the same display antenna arrangement; the figure merely being intended to show two different ways to arrange an antenna means, to cover other embodiments than those where the antenna is located at the back. In embodiments as in FIG. 9, none of the display means and the antenna means screens the other in any direction.

Figure 10:
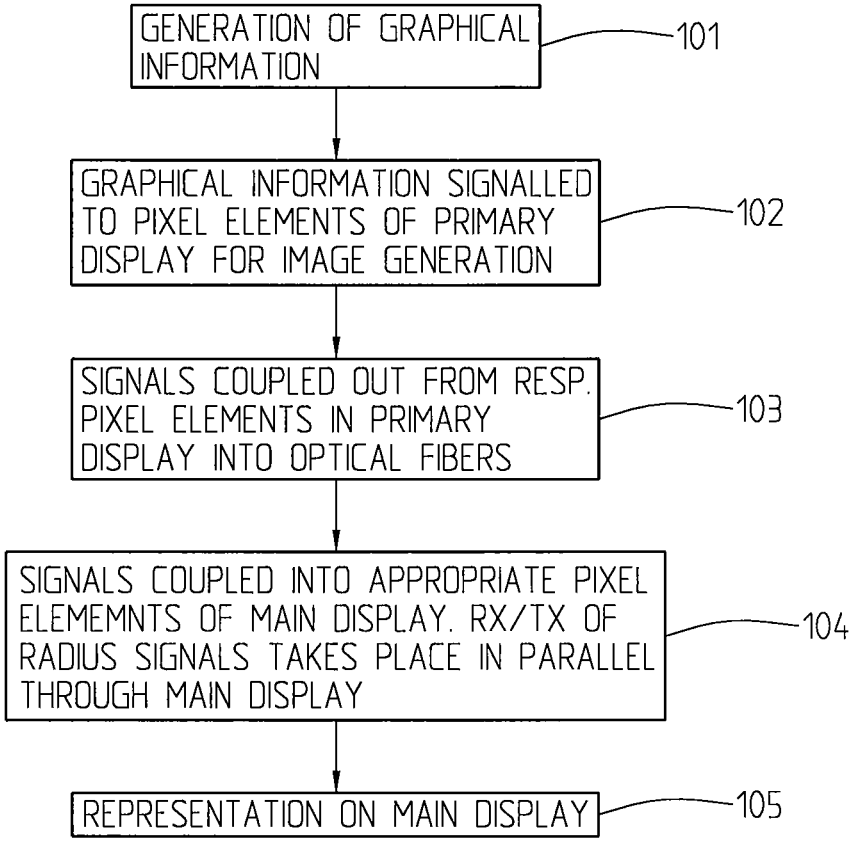
FIG. 10 is a schematical flow diagram describing the inventive concept.

FIG. 10 is a schematical flow diagram describing the procedure for presenting optical information on a display screen using an arrangement according to the present invention wherein the arrangement at the same time acts as a receiver/transmitter of radio signals through the screen. Graphical information is generated in image generating means, for example a graphics generator comprising computer graphic cards and drivers, 101. The graphical information is signalled to image generating pixel elements of a primary display, 102 (video signal to optic converter). The signals are then coupled out from the respective pixel elements in the primary display into optical fibers or waveguides, 103. At the other ends of the respective optical fibers, the signals are, optionally via coupling means also acting as lenses, coupled into appropriate pixel elements of a main display which is dielectric as well as the optical fibers, 104. Unless the optical fiber ends have been located in a very precise manner, a remapping based on initial calculation measurement, and calibration, has to be done to provide a correct representation of the image generated by means of the primary display, i.e. a passive transition of the viewing area, 104. Finally the optical information is represented on the main display screen, 105.

It should be clear that the invention can be varied in a number of ways without departing from the scope of the appended claims. The primary functional display is small and does not screen or interfere with an antenna means it can be located in principle anywhere, and the main display representing the image to the viewer is entirely dielectric and non-conductive such that it also does not screen the antenna means. This means that the antenna, of any kind, be provided anywhere and extend substantially throughout the entire surface of the main display, as long as it does not screen the display, in an appropriate manner which means that the antenna means in turn can be arranged in many different manners and be provided with appropriate directional characteristics, for example omni-directional and also can be processed by multiplexing, beam-forming etc. in any desired manner. With advantage the display antenna arrangement can be arranged in association with a laptop and of course with other wireless communication devices, projector means etc.; in general wherever a receiving/transmitting functionality is needed at the same time as an optical representation capability.

The invention claimed is:

1. A display arrangement comprising display means associated with receiving and/or transmitting elements comprising antenna elements for communication of radio-, millimeter wave or microwave signals and being adapted to be arranged in association with a wireless communication device, wherein the display means comprises a functional primary display means and a main display means, that the functional, primary display means comprises a number of first, small pixel elements and comprises or communicates with image generating means for generation of a high resolution miniature or compressed image, that the main display means comprises a dielectric material which is transparent to radio-, and/or millimeter waves and/or microwaves and comprises a number of second, passive, pixel elements substantially corresponding to the number of first, small, pixel elements, that said second pixel elements are considerably larger than said first pixel elements, that each first pixel element is connected to a second pixel element by means of an optical transmission means comprising optical fibres for transfer of optical image information, that the main display means is adapted to visually represent the transferred optical information as an enlarged image and to act as the display screen of said wireless communication device, the primary, functional display means being provided at an optional location of said communication device, and in that the antenna elements are arranged in or on the main display means such that reception/transmission can be done independently of optical representation and that said antenna elements are individually or groupwise controllable and/or feedable.

2. A display arrangement according to claim 1, wherein coupling means are provided for coupling the signal in to/out of the optical transmission means.

3. A display arrangement according to claim 2, wherein the coupling means comprise or are connected to lens devices for projection of the miniature image on to the larger main display means and that the lens devices are provided at the output from the first, primary functional display means and/or at the input to the second, main display.

4. A display arrangement according to claim 2, wherein a lens device is adapted to control and form a signal received from a respective small, first pixel element.

5. A display arrangement according to claim 2, wherein each optical fibre comprises coupling means comprising conversion means acting as lenses for converting and controlling the light signals from the first, primary display means to signals convenient for transportation through the optical fibre and/or for transfer to the main display means.

6. A display arrangement according to claim 1, wherein the receiving and/or transmitting elements are disposed at the back of the main display means.

7. A display arrangement according to claim 1, wherein the receiving and/or transmitting elements are integrated with the main display means, whereby an electrically conductive structure forming said receiving and/or transmitting elements is arranged such that receiving and/or transmitting elements are disposed between the second pixel elements.

8. A display arrangement according to claim 1, wherein the receiving and/or transmitting elements are arranged in an electrically conductive, optically transparent layer disposed at the front of the main display means.

9. A display arrangement according to claim 1, wherein the sizes and/or shapes of the antenna elements are adapted to depend on the frequency and/or polarization properties of communication channels for reception/transmission of said radio-, millimeter- or microwaves.

10. A display arrangement according to claim 1, wherein the antenna elements comprise patches, dipoles or coplanar antenna elements.

11. A display arrangement according to claim 1, wherein the primary functional display means comprises an LED, an OLED, an LCD display, TFT or similar.

12. A display arrangement according to claim 1, wherein the ends of the optical fibres, comprising a fibre bundle, and connecting to the main display means are adapted to be spread out and mounted for direct reproduction of the miniature image as an enlarged viewable image.

13. A display arrangement according to claim 1, wherein the ends of the fibres, comprising a fibre bundle, and connecting to the main display means are adapted to be spread out and in that mapping/re-mapping means are provided for mapping between image positions on the primary display means and known but randomly located fibre end positions on the main display means for enlarged reproduction of the miniature image.

14. A display arrangement according to claim 13, wherein the image generating means are adapted to control and/or adapt the light intensity and/or colour of the second pixel elements provided by the ends of the optical fibres located at the second, main display means.

15. A method for handling reception and/or transmission of radio/millimeter and/or microwave signals and optical representation of images in an arrangement comprising a display arrangement, the receiving/transmitting means comprising receiving/transmitting elements forming antenna elements and being adapted to be arranged in association with a wireless communication device, comprising a laptop, palmtop, mobile phone or similar, comprising the steps of:

generating a miniature or compressed image with a high resolution in a primary, functional display device comprising a number of first, small, pixel elements, transferring and converting the miniature or compressed image by means of an optical transmission means to a main display means acting as the display screen of said wireless communication device, the primary, functional display means being provided at an optional location of said wireless communication device, said main display means being considerably larger than said first functional display means, comprises a number of second pixel elements and comprises a non-electrically conductive, dielectric material which is transparent to radio-, and/or millimeter waves and/or microwaves, receiving/transmitting said radio-, millimeter- or microwave signals by means of receiving and/or transmitting elements forming antenna elements and being arranged on said main display means and individually and/or groupwise feeding and/or controlling said antenna elements.

16. A method according to claim 15, further comprising the step of:

receiving/transmitting radio/millimeter/microwaves in receiving/transmitting elements provided at the back of the main display means, said main display means being dielectric and transparent to radio/millimeter and/or microwaves.

17. A method according to claim 15, further comprising the step of:

receiving/transmitting radio/millimeter/microwaves in receiving/transmitting means integrated with or disposed at the front or top of the main display means, said receiving/transmitting elements being provided by means of an electrically conductive structure disposed between the second pixel elements or comprising an optically transparent electrically conductive layer.

18. A method according to claim 15, further comprising the step of:

transforming, by means of optical transmission means comprising optical fibres, pixel information from each first pixel element to respective second pixel element while mounting each optical fibre end at the second display means with an accuracy allowing enlarged direct representation of the miniature image.

19. A method according to claim 15, further comprising the steps of:

transferring pixel information from first pixel elements to second pixel elements located at random or arbitrary positions at the main display means, keeping information about said positions in image generating means, re-mapping the first pixel element information to appropriate second pixel elements to provide a projected enlarged, representation of the image.

* * * * *

UNITED STATES PATENT AND TRADEMARK OFFICE

CERTIFICATE OF CORRECTION

PATENT NO. : 8,654,037 B2
APPLICATION NO. : 12/746728
DATED : February 18, 2014
INVENTOR(S) : Harrysson et al.

It is certified that error appears in the above-identified patent and that said Letters Patent is hereby corrected as shown below:

In the Specification

Column 6, Line 28, delete "$1C_{11}$,...., $1C_{21}$" and insert -- $1C_{11}$,...., $1C_{31}$ --, therefor.

Column 6, Line 29, delete "means are" and insert -- means $9_1$ are --, therefor.

Column 6, Line 63, delete "$2A_{11}$,...., $2A_{61}$" and insert -- $2A_{11}$,...., $2A_{81}$ --, therefor.

Column 7, Line 13, delete "$2A_{11}$,...., $2A_{61}$" and insert -- $2A_{11}$,...., $2A_{51}$ are --, therefor.

Signed and Sealed this
Eighth Day of July, 2014

Michelle K. Lee

Michelle K. Lee
*Deputy Director of the United States Patent and Trademark Office*